US007681691B1

(12) United States Patent
Miller

(10) Patent No.: US 7,681,691 B1
(45) Date of Patent: Mar. 23, 2010

(54) PLANAR OBJECT LIFTING APPARATUS

(76) Inventor: William Miller, 17395 Oak Ave., Atascadero, CA (US) 93442

( * ) Notice: Subject to any disclaimer, the term of this patent is extended or adjusted under 35 U.S.C. 154(b) by 346 days.

(21) Appl. No.: 11/735,940

(22) Filed: Apr. 16, 2007

(51) Int. Cl.
*B66B 9/193* (2006.01)

(52) U.S. Cl. ..... 187/241; 187/239; 187/406; 414/11

(58) Field of Classification Search ..... 187/241, 187/239, 406
See application file for complete search history.

(56) References Cited

U.S. PATENT DOCUMENTS

| | | | | | |
|---|---|---|---|---|---|
| 118,468 | A | * | 8/1871 | Macomb | 187/407 |
| 261,880 | A | * | 8/1882 | Stevens | 187/337 |
| 286,116 | A | | 10/1883 | Clapp et al. | |
| 298,933 | A | * | 5/1884 | Barcus | 187/241 |
| 302,855 | A | * | 7/1884 | Lutz | 414/595 |
| 328,571 | A | | 10/1885 | Dawes | |
| 487,791 | A | * | 12/1892 | Stone | 187/261 |
| 573,630 | A | * | 12/1896 | Williams | 414/598 |
| 593,392 | A | * | 11/1897 | Fitch | 187/241 |
| 1,794,175 | A | * | 2/1931 | Honig | 182/103 |
| 1,808,954 | A | * | 6/1931 | Hallenbeck | 187/406 |
| 1,946,982 | A | * | 2/1934 | Mepeak | 187/264 |
| 2,405,505 | A | | 8/1946 | Kleidon | |
| 2,626,683 | A | | 1/1953 | Eppink | |
| 2,702,095 | A | | 2/1955 | Kelly | |
| 3,055,523 | A | * | 9/1962 | Wurn | 414/498 |
| 3,089,599 | A | * | 5/1963 | Casella | 414/11 |
| 3,115,211 | A | * | 12/1963 | Ostrander, Jr. | 182/103 |
| 3,223,199 | A | | 12/1965 | Schwehr | |
| 3,666,054 | A | * | 5/1972 | Ellings et al. | 182/103 |
| 3,770,133 | A | * | 11/1973 | Kolker | 211/19 |
| 3,891,062 | A | | 6/1975 | Geneste | |
| 3,902,700 | A | * | 9/1975 | Cox | 182/102 |
| 4,312,328 | A | * | 1/1982 | Leyman, III | 126/627 |
| 4,458,786 | A | * | 7/1984 | Lebre | 187/231 |
| 4,487,308 | A | * | 12/1984 | Focke et al. | 198/412 |

(Continued)

*Primary Examiner*—Thomas J. Brahan
(74) *Attorney, Agent, or Firm*—Philip A Steiner

(57) ABSTRACT

An apparatus for lifting planar objects which includes an extendable rectilinear elongated frame formed of at least two spaced U-beams, each U-beam defining a longitudinal runway and having an elongated area removed from a forward face below a midpoint of the frame. The removed elongated area defines an entranceway to the longitudinal runway. The entranceway is dimensioned to receive the planar object for placement on a transport carriage while maintaining a top portion of the planar object within the longitudinal runway. The carriage is configured to laterally span the two spaced U-beams such that a portion of the carriage and a portion of the planar object are confined within each interior longitudinal runway at least during transport. A skid is perpendicularly joined to a forward face of the carriage at about its bottom edge. The skid is configured to support the planar object during placement and lifting. A pull cable is affixed at one end to the carriage at about a midpoint of a lateral dimension and in proximity to a top edge of the carriage. A first cross member is laterally joined to a top of the frame which includes a pulley aligned such that the pull cable when in communication with the pulley and affixed to the carriage are aligned along a common longitudinal centerline between the two spaced U-beams. A second cross member is likewise laterally joined to the frame in proximity to the entranceway. A winch is connected to an opposite end of the pull cable and configured to move the carriage and planar object through the longitudinal runways.

22 Claims, 6 Drawing Sheets

U.S. PATENT DOCUMENTS 4,491,196 A 1/1985 Bocker
4,550,806 A 11/1985 Bocker
4,607,574 A 8/1986 Richards
5,706,798 A * 1/1998 Steinorth ..... 126/681
2008/0093176 A1* 4/2008 Rosenthal ..... 187/241

* cited by examiner

PLANAR OBJECT LIFTING APPARATUS

CROSS-REFERENCE TO RELATED APPLICATIONS

Not Applicable

RELEVANT INVENTIVE FIELD

The various exemplary embodiments relate generally to a mechanical lifting apparatus and more specifically to an apparatus for lifting planar objects from a first level to a second level.

BACKGROUND

Lifting planar objects such as plywood, glass, roofing panels and solar energy panels are subject to handling and environmental hazards. For example, attempting to hand carry a sheet of plywood up a ladder creates safety hazards for the handler and those working in the vicinity of the ladder. Moreover, planar objects are subject to wind influences which cause the planar objects to act as a sail, thus increasing the risk of damage and/or injuries from the movement of these objects. As such, a simple lifting apparatus which reduces the risks inherent in the physical handling of planar objects would be highly desirable in the relevant art.

SUMMARY

The various exemplary embodiments disclosed herein address the deficiencies of the relevant art and provides a planar object lifting apparatus which is simple to use, minimizes handling and is less vulnerable to wind effects. In an exemplary embodiment, a rectilinear elongated frame is provided. The frame formed from two spaced U-beams aligned in opposition such that each U-shaped channel of the U-beam defines a longitudinal runway. A section below the middle of the frame includes an area removed from a forward face which defines an entranceway to the longitudinal runways for placement of the planar objects to be lifted. The entranceway is dimensioned to receive the planar object for placement on a transport carriage.

The carriage is dimensioned to laterally span the two spaced U-beams such that a portion of the carriage and a portion of the planar object are confined within each interior longitudinal runway during lifting. The carriage includes a skid perpendicularly joined to a forward face of the carriage at about a bottom edge. The skid provides support to the planar object during lifting. A pull cable is affixed at one end to the carriage at about a midpoint of its lateral dimension and in proximity to a top edge of the carriage. A first cross member is laterally joined to a top of the frame. The first cross member includes a pulley aligned such that the pull cable when in communication with the pulley and affixed to the carriage are aligned along a common longitudinal centerline between the two U-beams.

A second cross member is laterally joined to the frame in proximity to the entranceway. In an exemplary embodiment, the first and second cross members define an upper and lower length of travel for the carriage within the longitudinal runways. In an exemplary embodiment, the first and second cross members are laterally adjustable to accommodate planar objects of varying widths. A winch is coupled to an opposite end of the pull cable and configured to move the carriage and planar object through the longitudinal runways. The winch may be manually or electrically cranked.

BRIEF DESCRIPTION OF DRAWINGS

The features and advantages of the various exemplary embodiments will become apparent from the following detailed description when considered in conjunction with the accompanying drawings. Where possible, the same reference numerals and characters are used to denote like features, elements, components or portions of the inventive embodiments. It is intended that changes and modifications can be made to the described exemplary embodiments without departing from the true scope and spirit of the inventive embodiments as is defined by the claims.

DETAILED DESCRIPTION

Planar objects, such as fiberglass roofing panels, roofing shingles, plywood, solar electric photovoltaic panels, window glass and other planar objects are difficult to handle and carry particularly under windy conditions. In the case of the solar electric photovoltaic panels, each panel is both fragile and expensive. Attempting to lift a solar panel under windy conditions could result in damage to the panel, property damage or personnel injury.

Figure 1:
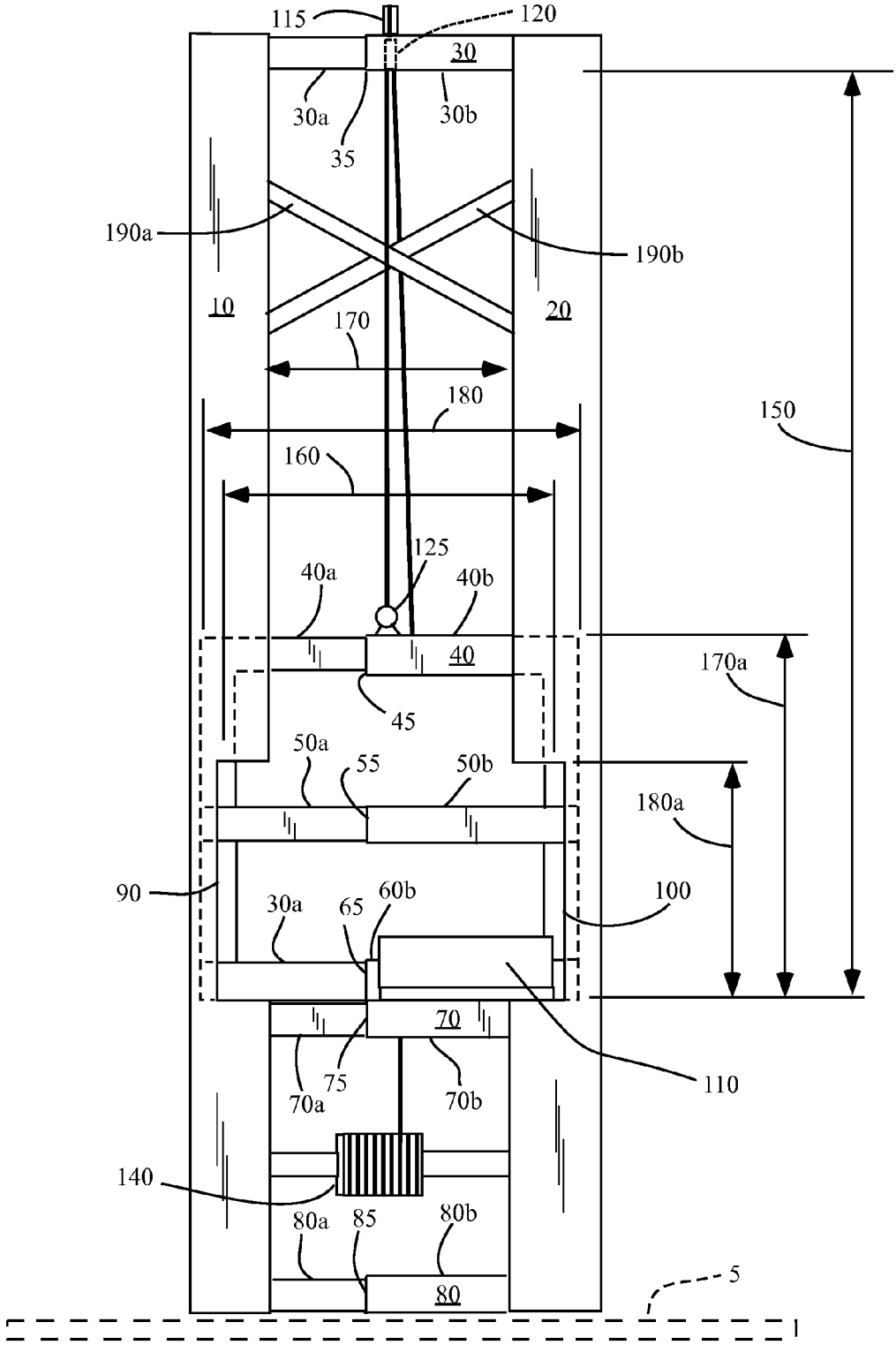
FIG. 1 depicts a generalized frontal view of an exemplary embodiment of a planar object lifting apparatus.
Figure 3:
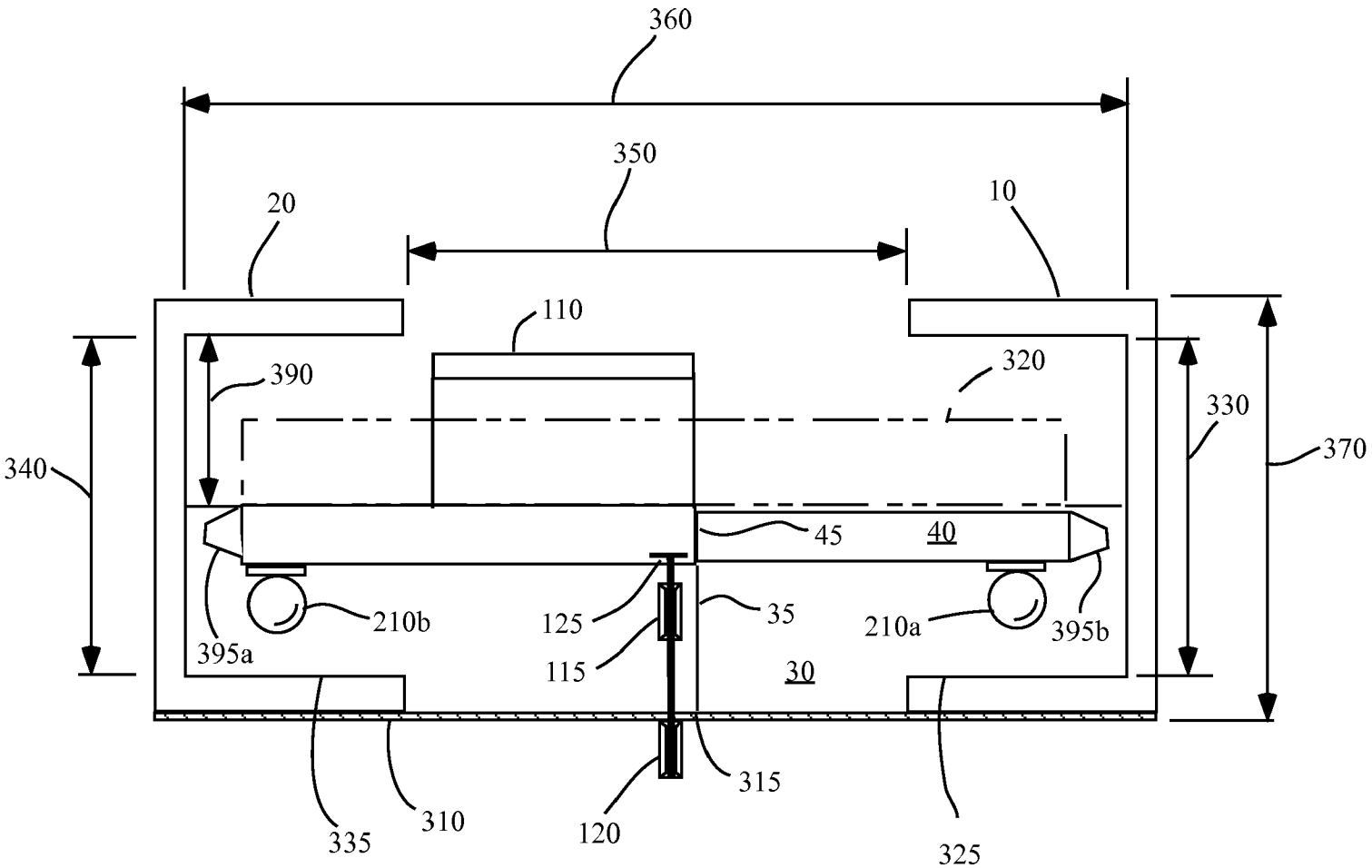
FIG. 3 depicts an exemplary embodiment of a top cross sectional view of the carriage having a planar object disposed thereon.

Referring to FIG. 1, an exemplary embodiment of a planar object lifting apparatus is depicted, hereinafter referred as the "lift." The lift is comprised of a pair of U-beams 10, 20 which forms an elongated longitudinal frame. The U-beams 10, 20 are laterally aligned such that the U-shaped channels are aligned in opposition to form a common longitudinal runway 360 (FIG. 3.) Two or more lateral cross members 30, 70, 80 are joined to the frame at various positions along the frame to provide structural integrity. In an exemplary embodiment, the first and second cross members 30, 70 are used to define a vertical length of travel 150 for a transport carriage 40.

In an exemplary embodiment, the cross members 30, 70, 80 may be constructed from telescoping rectangular, L-brackets or tube stock to allow the lateral dimensions of the lift to be adjusted. In this exemplary embodiment, the cross members 30, 70, 80 are constructed from two different diameters or cross sectional areas 30A,B, 70A,B, 80A,B.

In another exemplary embodiment, the cross members are constructed from aluminum L-beams which have overlapping sections. The overlapping sections are than bolted or welded together. The cross members 30, 70, 80 may be predrilled to allow common lateral adjustments and locked in place with a pin, bolt, or other mechanism at common junctions 35, 75, 85 between the telescoping sections 30A,B, 70A,B, 80A,B.

In an exemplary embodiment, additional cross braces 190A,B are longitudinally affixed periodically along the rear surfaces of the U-beams 10, 20. The cross braces 190A,B are intended to provide additional structural integrity to the frame. The cross braces may be aligned in an X configuration using thin strips of aluminum or other suitable materials or in zigzag configuration when using L-beams (not shown.)

The carriage 40 is raised and lowered through the longitudinal runways 330, 340 (FIG. 3) by pulley 115, 120 and winch 140 arrangement. The winch 140 may be hand operated 140 or electrically powered (not shown.) One pulley 115 is affixed to the first cross member and axially aligned with a longitudinal centerline of the carriage 40. A pull cable 130 is affixed at one 125 to the carriage and at an opposite end to the winch 140. The location and orientations of the pulleys 115, 120 are not critical. In one exemplary embodiment, the pulleys 115, 120 are aligned in parallel about a traverse lateral midpoint of the first cross member 30. In this exemplary embodiment, the pulleys 115, 120 direct the pull cable 130 rearward and maintain a longitudinal orientation. In another exemplary embodiment, the pulleys 115, 120 direct the pull cable 130 laterally in parallel to the first cross member 30 and then longitudinally downward to the winch 140.

In this exemplary embodiment, the second pulley 120 allows the winch 140 to be mounted on a side of the lift. The attachment point 125 of the pull cable 130 may utilize an eye-bolt affixed at or near the top edge of carriage 40, a hole bored through the carriage 40 or any common means of attaching a cable for pulling an object. One skilled in the art will appreciate that there are many common ways of attaching the pull cable 130 to the carriage 40.

To allow placement of a planar object on the carriage 40, parallel elongated sections 90, 100 of the U-beams are removed from their forward faces. The removed sections 90, 100 define an aperture 160, 180 to allow loading of planar objects onto the carriage 40. As an alternative to removal of the parallel sections 90, 100, L-beams may be affixed and longitudinally aligned to the lower ends of the U-beams 10, 20 to form the aperture 160, 180.

The carriage 40 is disposed within the longitudinal runways 330, 340 and dimensioned to longitudinally extend from the lower end of travel defined by a cross member 70 slightly beyond the longitudinal dimension of the aperture 180 to prevent the carriage from becoming dislodged from the longitudinal runways 330, 340 during loading. In an exemplary embodiment, the lateral dimensions 180 of the carriage 40 are slightly smaller than the lateral extent 360 (FIG. 3) of the void space between the parallel U-beams 10, 20 inclusive of the U-shaped channels. In another exemplary embodiment, the lateral dimension of the carriage 40 is approximately equal to the lateral extent of the aperture 160. In an exemplary embodiment, the dimensions of the carriage 40 are approximately 34 inches laterally and 48 inches longitudinally. This arrangement is considered appropriate to lift solar electric panels having dimensions of approximately 32 inches laterally and 64 inches longitudinally. The thickness of the solar electric panels is typically in the range of 1½ inches to 2 inches. However, the dimensions may vary somewhat by manufacturer.

In an exemplary embodiment, the lateral dimensions of the carriage 40 may be configured with the telescoping stock arrangement described for the cross members 30, 70, 80 above. In this exemplary embodiment, the carriage 40 is constructed of telescoping sections 40A,B, 50A,B, 60A,B which allows for changes in the lateral extent of the carriage to accommodate varying lateral dimensions of planar objects to be lifted. As previously described, the telescoping sections 40A,B, 50A,B, 60A,B may be predrilled to allow common lateral adjustments and locked in place with a pin, bolt or other mechanism at common junctions 45, 55, 65 between the telescoping sections 40A,B, 50A,B, 60A,B.

In an exemplary embodiment, one or more skids 110 are affixed perpendicularly to a forward face of the carriage 40 at or near a bottom edge of the carriage 40. The skid 110 may be constructed from aluminum L or U beam stock.

The 30A,B, 70A,B, 80A,B provide support for the planar objects being lifted. The 30A,B, 70A,B, 80A,B are dimensioned to provide a sufficient cross sectional area to support the weight of the planar objects to be lifted. The skid 110 may be affixed to the carriage 40 so as to travel in the void space 170 between the U-beams 10, 20 during lifting. Configuring the skid 110 to extend forward beyond the traverse cross sectional extent of the U-beams 10, 20 provide greater flexibility in load distribution when lifting irregularly shaped planar objects.

The lift is envisioned to be constructed of aircraft grade aluminum of at least 6061-T6 for longitudinal dimensions of up to 10 feet or 2024-T3 or 7075-T6 where longitudinal dimensions of greater than 10 feet are anticipated. The carriage 40 including the skid 110 may be constructed from equivalent aluminum materials. Alternately, the U-beams 10, 20, cross members 30, 70, 80 and the carriage 40 may constructed from pulltruded fiberglass, other grades of aluminum or composite carbon fiber materials to reduce weight. Typical dimensions of the U-beams when constructed from aluminum stock are approximately 13 feet in length each, aligned in parallel and spaced approximately 46 inches apart. The U-beams are constructed from standard 5¾ inch U-beam stock. To obtain the 13 foot length, two or more U-beams may be longitudinally connected by wielding or overlapping the sections with a larger U-beam section which provides at least 10 inches of overlap. The larger U-beam section used to join the U-beams should provide a snug fit around the two U-beam sections to ensure structural integrity of the lift. U-beam sections may be added or removed to accommodate a specific implementation.

The pull cable should preferably be constructed of nylon coated stainless steel type 304 having at least an eighth of an inch in diameter for loads up to 900 pounds. The winch 140 may be either electrically or manually powered. Common boat type winches are satisfactory for use with the lift. An optional base 5 may be provided to prevent the lift from becoming embedded or unbalanced in soft soils or turfs.

Figure 2:
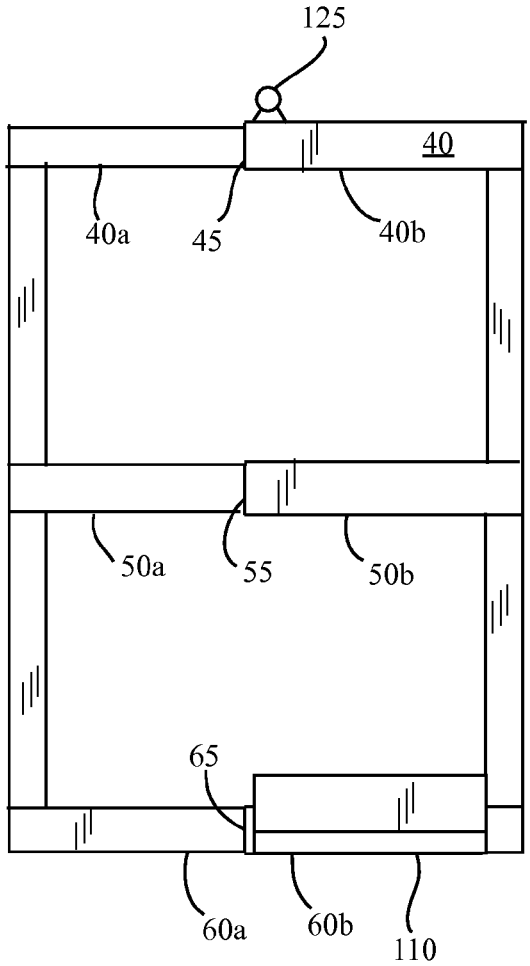
FIG. 2 depicts an exemplary embodiment of a carriage suitable for use with the planar object lifting apparatus.

FIG. 2 depicts an exemplary frontal view of the carriage 40. In an exemplary embodiment, the carriage 40 may include a generally open frame 205, 215 arrangement. The open frame arrangement is advantageous for reducing the weight of the carriage 40. Generally, the bottom section(s) 60A, 60B of the carriage 40 incur the highest dynamic and static loads. Therefore, the bottom section(s) 60A, 60B and the skid 110 should be constructed to support the maximum weight to be lifted by the carriage 40. In addition, the length of the skid 110 could transmit torsional forces to the frame of the carriage during lifting which should be taken into consideration.

As previously discussed, the carriage 40 may be constructed to allow changes to the lateral dimension by fabricating sections 40A,B, 50A,B, 60A,B from telescoping tube or angle stock. The telescoping sections 40A,B, 50A,B, 60A,B allows for changes in the lateral extent of the carriage 40 to accommodate varying lateral dimensions of planar objects to be lifted. The telescoping sections 40A,B, 50A,B, 60A,B may be predrilled to allow common lateral adjustments and locked in place with a pin or other mechanism at the common junctions 45, 55, 65 between the telescoping sections 40A,B, 50A,B, 60A,B.

Figure 2A:
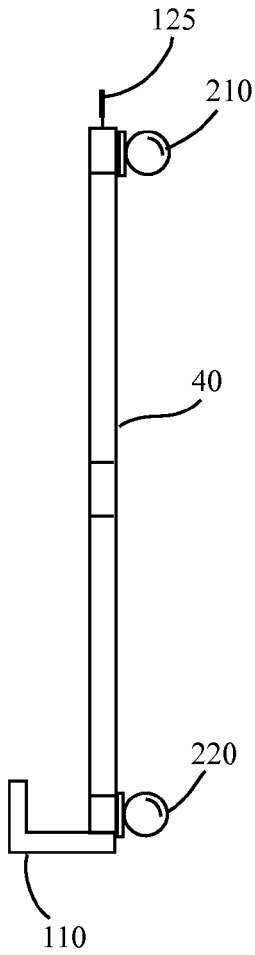
FIG. 2A depicts an exemplary side view of the carriage.

FIG. 2A depicts an exemplary side view of the carriage 40. In this exemplary embodiment, the carriage 40 is provided with a set of rollers or wheels 210, 220 which minimizes friction and allows the carriage 40 to smoothly travel within the longitudinal runway 360.

FIG. 3 depicts an exemplary top cross sectional view of the carriage 40 confined within the longitudinal runway 360 and having a planar object 320 such as a solar electric panel loaded thereon. The carriage 40 glides on the wheels 210A,B within the common channel formed by the U-beams 10, 20. The glide surfaces 325, 335 are generally the rearward inner surfaces of the U-beams 10, 20. In an exemplary embodiment, the uppermost cross member 30 provides an end of travel stop for the carriage 40 but does not impede removal of the planar object 320 from the carriage 40. An aperture defined by a forward interior edge of the first cross member 390 and the lateral common channel 360 allows the planar object 320 to extend beyond the longitudinal extent of the uppermost cross member 30. This arrangement allows for the easy removal of the planar object 320 without exceeding the maximum length of travel 150 of the carriage 40. As previously discussed, the skid 110 may extend beyond the forward faces of the U-beams 10, 20, however, a portion of the planar object 320 should be confined with the interiors of the U-beams 10, 20 to prevent dislodging due to wind gusts or irregular pulling motions. Plastic runners 395A,B may be provided on the lateral edges of the carriage 40 where desirable to minimize friction between the carriage 40 and the interior surfaces of the longitudinal runway 360.

Figure 4:
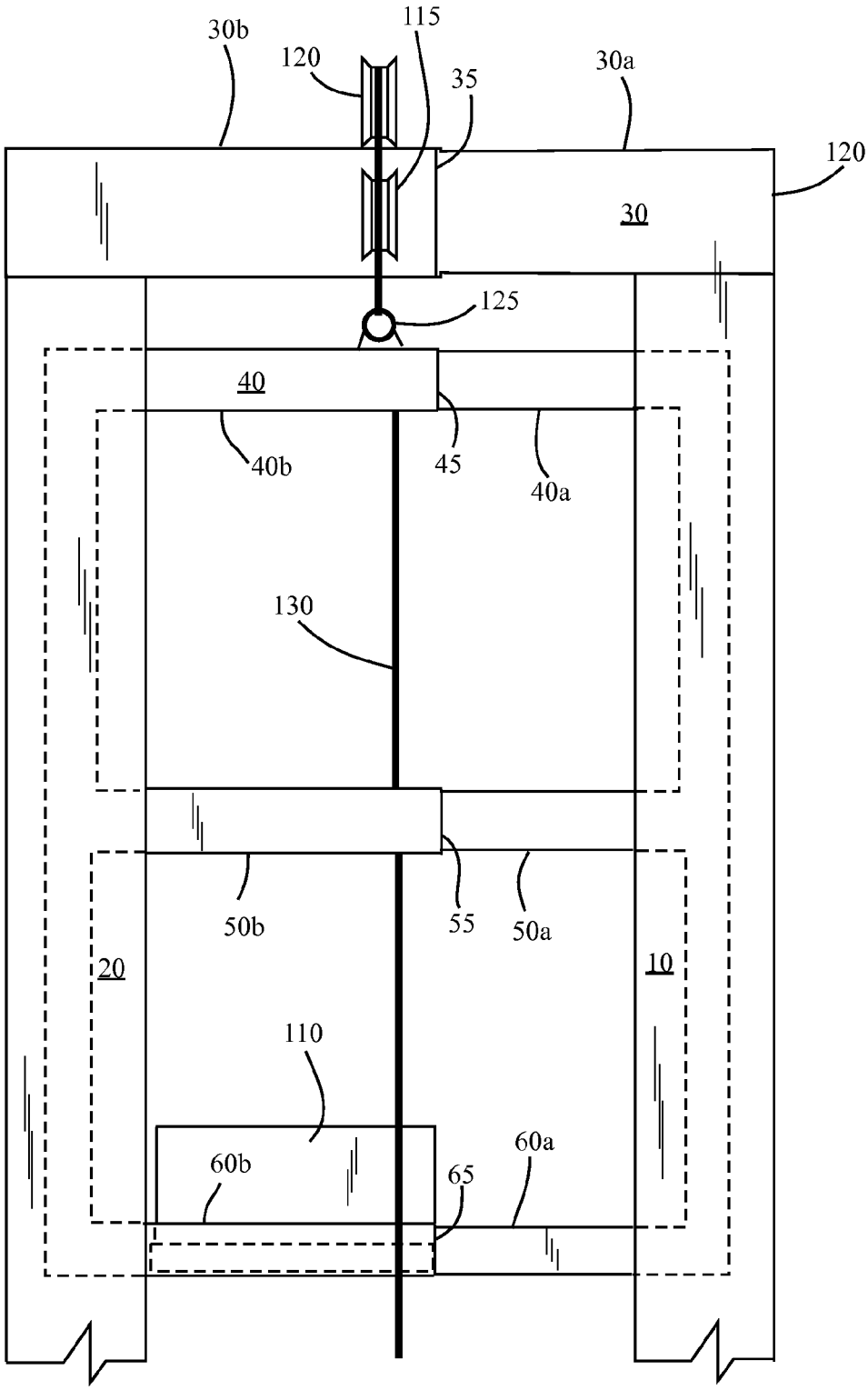
FIG. 4 depicts a partial rear view of the lifting apparatus with the carriage near the upper travel limit.

FIG. 4 depicts a partial rear view of the lift with the carriage 40 near the upper travel limit. In this exemplary embodiment, a pair of pulleys 115, 120 is used to transmit pulling forces generated by the winch 140 and carried by the pull cable 130 to the carriage 40. The first pulley 115 is affixed to the first cross member 30 so as to uniformly exert the pulling force on the eyelet 125 in the longitudinal axis. In certain situations, a non-uniformly weighted load or irregularly shaped object may cause the carriage 40 to be pulled in a somewhat skewed manner. The second pulley 120 is provided in a common rearward plane with the first pulley 115 for redirection of the pull cable 130 downward in parallel to the U-beams 10, 20. The second pulley 120 improves the mechanical advantage and also assists in load balancing where it is desirable to mount the winch 140 on the rear of the lift.

Figure 5:
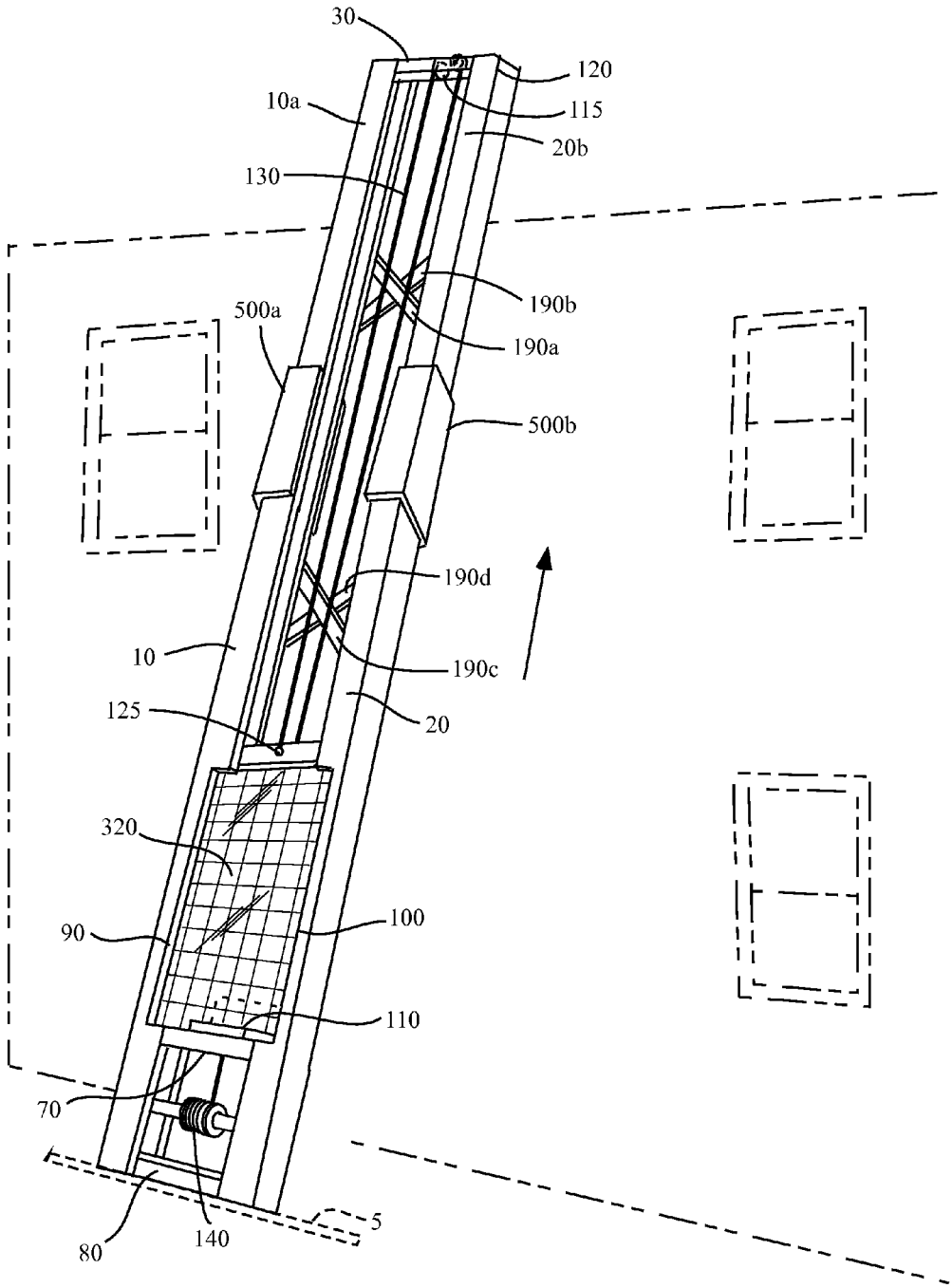
FIG. 5 depicts a perspective view of the lifting apparatus disposed against a building and configured to lift a planar object.

FIG. 5 depicts a perspective view of the lift erected against a building for use in lifting a planar object 320. In this exemplary embodiment, the lift is placed at a slight incline against the building. The incline allows the carriage 40 and attached wheels or rollers 210A, 210B to properly glide along the interior rear surfaces of the U-beams 10, 20. Where necessary, the optional base 5 may be placed below the frame to prevent the lift from sinking to soft soil, turf, etc. Where necessary to extensions of the lift may be provided by installing overlapping sections 500A,B of U-beams to longitudinally couple additional lengths of U-beams 10A, 20A to the base U-beams 10, 20. The overlapping sections 500A,B of U-beams are typically the next standard larger cross sectional size and overlap by at least 10 inches either side of the individually added lengths of U-beams to maintain the structural integrity of the lift.

Figure 6:
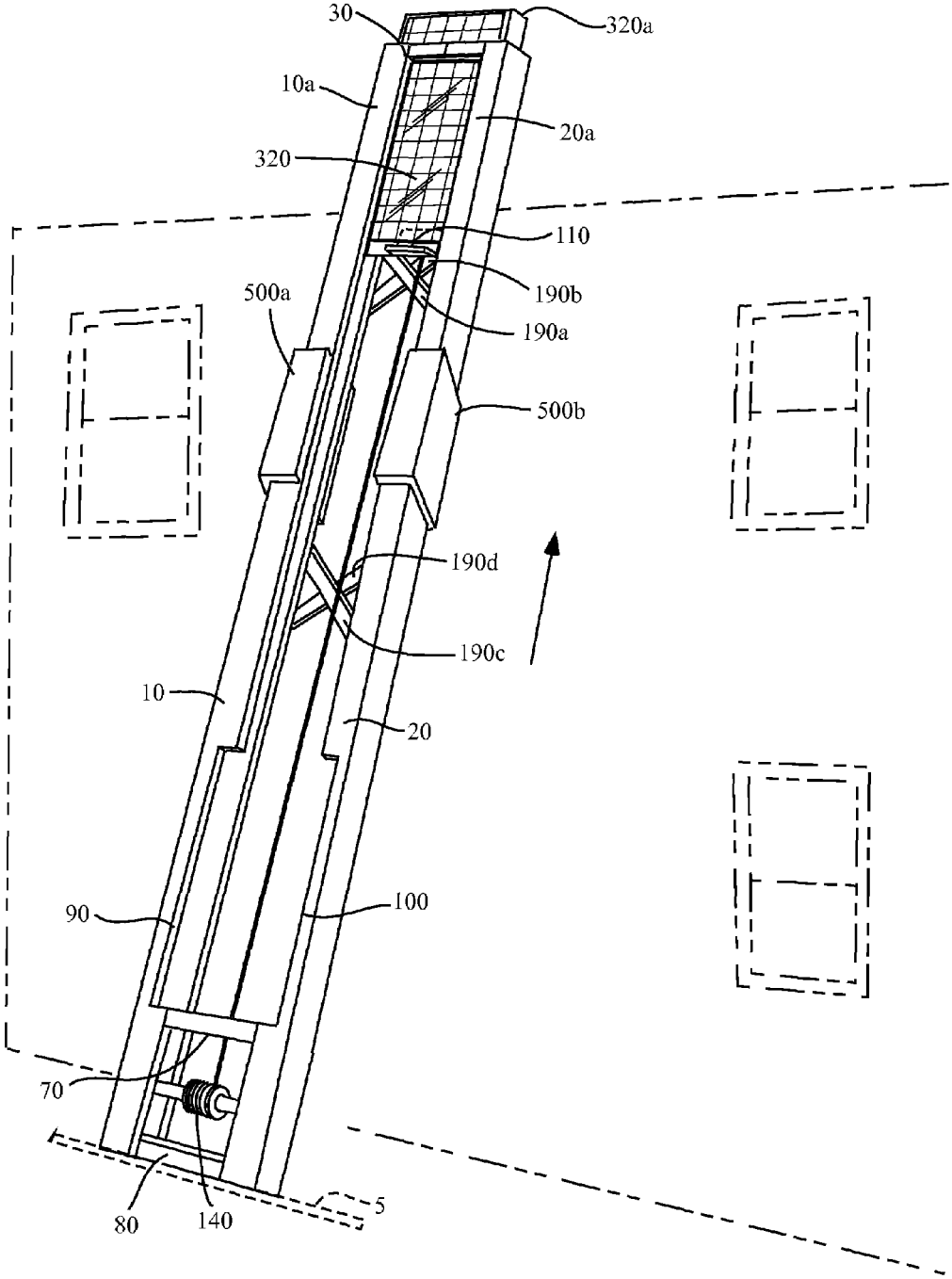
FIG. 6 depicts a perspective view of the lifting apparatus disposed against a building with the planar object protruding sufficiently to be removed from the lifting apparatus.

The planar object 320, for example a solar electric panel, is then inserted at a slight angle into the aperture defined by the removed elongated sections 90, 100 such that a portion of the planar object is encompassed within the U-beams 10, 20 and then set upon the skid 110. Once positioned on the skid 110 and carriage 40, the winch 140 is then turned to raise the planar object 320 and carriage 40 until the carriage 40 reaches the upper end of travel defined by the first cross member 30 or sufficient gripping surface 320A of the planar object 320 projects beyond the first cross member 30 for safe removal as is depicted in FIG. 6.

The various exemplary inventive embodiments described herein are intended to be merely illustrative of the principles underlying the inventive concept. It is therefore contemplated that various modifications of the disclosed embodiments will, without departing from the inventive spirit and scope, be apparent to persons of ordinary skill in the art. They are not intended to limit the inventive embodiments to any precise form described. In particular, it is contemplated that the lift and related components may be constructed from any suitable No specific limitation is intended to a particular construction material or units of measure are intended or implied. Other variations and inventive embodiments are possible in light of above teachings, and it is not intended that this Detailed Description limit the inventive scope, but rather by the Claims following herein.

The invention claimed is:

1. A planar object lifting apparatus comprising:

a rectilinear elongated frame formed of two spaced U-beams, each U-beam defining a longitudinal runway and having an elongated open area along a longitudinal face, the open area being below a midpoint of the frame and defining an entranceway to the longitudinal runways; the entranceway dimensioned to receive the planar object to be lifted;

a carriage for transport of the planar object disposed thereon, the carriage dimensioned to laterally span the two spaced U-beams such that a portion of the carriage and the planar object disposed thereon are confined within a lateral common channel defined by the longitudinal runways during lifting;

a skid perpendicularly joined to a forward face of the carriage at about a bottom edge of the carriage configured to support the planar object during lifting;

a pull cable affixed at one end to the carriage at about a midpoint of a lateral dimension and in proximity to a top edge of the carriage;

a first cross member laterally joined to a top of the frame including a first pulley aligned such that the pull cable when in communication with the first pulley and affixed to the carriage are aligned along a common longitudinal centerline between the two spaced U-beams;

a second cross member laterally joined to the frame in proximity to the entranceway; and, a winch coupled to an opposite end of the pull cable and configured to move the carriage and planar object through the longitudinal runways.

2. The apparatus according to claim 1 further comprising a set of rollers configured to aid in the movement of the carriage during lifting.

3. The apparatus according to claim 2 wherein the set of rollers are affixed to a rear surface of the carriage and configured to maintain rotational communication with the longitudinal runways during lifting.

4. The apparatus according to claim 2 wherein the set of rollers are affixed to the frame and configured to maintain rotational communication with a rearward surface of the carriage during lifting.

5. The apparatus according to claim 1 wherein the rectilinear elongated frame is longitudinally extendable.

6. The apparatus according to claim 1 wherein the first and second cross members define a length of travel for the carriage.

7. The apparatus according to claim 1 wherein a lateral cross sectional area of the first cross member is less than a lateral cross sectional area of the frame.

8. The apparatus according to claim 7 wherein an elongated aperture is defined from the differences in the cross sectional areas of the first cross member and the frame; the elongated aperture having a sufficient cross sectional area to allow the planar object to longitudinally project beyond the first cross member.

9. The apparatus according to claim 1 wherein the first cross member further comprises a second pulley disposed in proximity to a lateral edge of the frame, the second pulley configured to route the pull cable from the first pulley to the winch.

10. The apparatus according to claim 1 where in the winch is either manually operated or electrically operated.

11. The apparatus according to claim 1 wherein the frame is longitudinally dimensioned to allow lifting of the planar object from a first story to a second story of a structure.

12. The apparatus according to claim 1 wherein the planar object is a solar energy panel.

13. The apparatus according to claim 1 wherein a width of the carriage is adjustable.

14. A planar object lifting apparatus comprising:

a rectilinear elongated frame formed of two spaced beams, each beam including a U-shaped channel section and an elongated opening; the U-shaped channel sections defining longitudinal runways and the elongated opening defining an entranceway dimensioned to receive the planar object to be lifted;

a carriage for transport of the planar object disposed thereon, the carriage dimensioned to laterally span the two spaced beams such that a majority of the carriage and the planar object disposed thereon are confined within a lateral common channel defined by the longitudinal runways during lifting;

a skid perpendicularly joined to a forward face of the carriage at about a bottom edge of the carriage configured to support the planar object during lifting;

a pull cable affixed at one end to the carriage at about a midpoint of a width and in proximity to a top edge of the carriage;

a first cross member laterally joined to a top of the frame having a lateral cross sectional area approximating a lateral cross sectional area of the carriage; the first cross member joined to the top of the frame so as to provide a upper end of travel of the carriage;

a first pulley coupled to the first cross member and configured such that the pull cable when in communication with the first pulley maintains alignment with a common longitudinal centerline between the two spaced beams and the carriage;

a second cross member laterally joined to a rear of the frame at about a bottom of the entranceway; the second cross member joined to the rear of the frame so as to provide a lower end of travel of the carriage; and, a winch coupled to an opposite end of the pull cable and configured to move the carriage and the planar object disposed thereon between the upper and lower ends of travel.

15. The apparatus according to claim 14 wherein an elongated aperture is defined from differences between a lateral cross sectional area of the first cross member and lateral cross sectional area of the frame; the elongated aperture having a sufficient cross sectional area to allow the planar object to longitudinally project beyond the first cross member for removal of the planar object from the carriage.

16. The apparatus according to claim 14 wherein the frame is longitudinally dimensioned to allow lifting of the planar object from a first story to a second story of a structure.

17. The apparatus according to claim 14 wherein a longitudinal length of the planar object is greater than a longitudinal length of the carriage.

18. The apparatus according to claim 14 wherein each U-shaped channel is laterally aligned in opposition to define a common elongated aperture in which the skid travels during lifting.

19. A planar object lifting apparatus comprising:

a rectilinear elongated frame formed of two spaced beams, each beam including a U-shaped channel section and an elongated opening; the U-shaped channel sections defining longitudinal runways and the elongated opening defining an entranceway dimensioned to receive the planar object to be lifted;

a carriage for transport of the planar object disposed thereon, the carriage dimensioned to laterally span the two spaced beams such that all of the carriage and all of the planar object are confined within a lateral common channel defined by the longitudinal runways during lifting;

a skid perpendicularly joined to a forward face of the carriage at about a bottom edge of the carriage configured to support the planar object during lifting;

a pull cable affixed at one end to the carriage at about a midpoint of a width and in proximity to a top edge of the carriage;

a first cross member laterally joined to a top of the frame having a lateral cross sectional area approximating a lateral cross sectional area of the carriage; the first cross member joined to the top of the frame so as to provide a upper end of travel of the carriage;

a first pulley coupled to the first cross member and configured such that the pull cable when in communication with the first pulley maintains alignment with a common longitudinal centerline between the two spaced beams and the carriage;

a second cross member laterally joined to a rear of the frame at about a bottom of the entranceway; the second cross member joined to the rear of the frame so as to provide a lower end of travel of the carriage; and, a winch coupled to an opposite end of the pull cable and configured to move the carriage and the planar object disposed thereon between the upper and lower ends of travel.

20. The apparatus according to claim 19 wherein an elongated aperture is defined from differences between a lateral cross sectional area of the first cross member and lateral cross sectional area of the frame; the elongated aperture having a sufficient cross sectional area to allow the planar object to longitudinally project beyond the first cross member for removal of the planar object from the carriage.

21. The apparatus according to claim 19 wherein the frame is longitudinally dimensioned to allow lifting of the planar object from a first story to a second story of a structure.

22. The apparatus according to claim 19 wherein the rectilinear elongated frame is longitudinally extendable.

* * * * *